US006477994B2

(12) United States Patent
Umemoto et al.

(10) Patent No.: US 6,477,994 B2
(45) Date of Patent: Nov. 12, 2002

(54) ELECTROMAGNETIC DRIVING VALVE OF INTERNAL COMBUSTION ENGINE

(75) Inventors: Atsushi Umemoto, Wako (JP); Kenji Abe, Wako (JP); Yoshinori Onohara, Wako (JP); Kouichi Ikoma, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/988,451

(22) Filed: Nov. 16, 2001

(65) Prior Publication Data

US 2002/0056421 A1 May 16, 2002

(30) Foreign Application Priority Data

Nov. 16, 2000 (JP) ..... 2000-349465

(51) Int. Cl.[7] ..... F01L 9/04; F16K 31/06

(52) U.S. Cl. ..... 123/90.11; 123/90.55; 251/129.1; 251/129.16

(58) Field of Search ..... 123/90.11, 90.49, 123/90.55; 251/129.01, 129.1, 129.15, 129.16

(56) References Cited

U.S. PATENT DOCUMENTS 6,089,197 A * 7/2000 Lange et al. ..... 123/90.11
6,116,570 A * 9/2000 Bulgatz et al. ..... 251/129.1
6,289,858 B1 * 9/2001 Altdorf et al. ..... 123/90.11
6,354,253 B1 * 3/2002 Katsumata et al. ..... 123/90.11

* cited by examiner

*Primary Examiner*—Weilun Lo
(74) *Attorney, Agent, or Firm*—Lahive & Cockfield, LLP

(57) ABSTRACT

The invention provides an electromagnetic driving valve of an internal combustion engine provided with a significantly compact shock absorbing means which can reduce an impact sound and a vibration in a contact portion between a first transmission shaft and a second transmission shaft and reduce an impact sound and a vibration generated at a time when a valve portion sits on an intake and exhaust port at a time of closing a valve. A shock absorbing means (27) is provided between a first transmission shaft (14*a*) extended upward from a valve portion (3) and a second transmission shaft (14*b*) extended on the same axis thereof and supporting a movable plate (7) between a pair of electromagnets (5, 6). The shock absorbing means (27) is provided with a contact connecting means (28) connected to an upper end of the first transmission shaft (14*a*) and freely extending and compressing while maintaining a contact with a lower end of the second transmission shaft (14*b*), and an oil receiving portion (29) slidably inserting the contact connecting means (28) thereto and gradually discharging a fluid charged in an inner portion thereof together with an upward movement of the contact connecting means (28) at a time of a valve closing operation of the valve portion (3), thereby reducing a valve closing speed of the valve portion (3) via the first transmission shaft (14*a*).

7 Claims, 2 Drawing Sheets

ELECTROMAGNETIC DRIVING VALVE OF INTERNAL COMBUSTION ENGINE

BACKGROUND OF THE INVENTION

1. Field of the Invention

The present invention relates to an electromagnetic driving valve of an internal combustion engine for opening and closing an intake and exhaust port of an internal combustion engine.

2. Description of the Prior Art

Conventionally, there has been known an electromagnetic driving valve for driving a valve portion opening and closing an intake and exhaust port of an internal combustion engine, by an electromagnet. This kind of electromagnetic driving valve is provided with a movable plate connected to a transmission shaft extending to the above of the valve portion, and a pair of electromagnets vertically opposing to each other via the movable plate. The movable plate is sucked due to an electromagnetic force which both of the electromagnets alternately generate, thereby moving between both of the electromagnets. Further, when the movable plate is adsorbed to the upper electromagnet, the valve portion closes the intake and exhaust port, and when the movable plate is adsorbed to the lower electromagnet, the valve portion opens the intake and exhaust port.

In this kind of electromagnetic driving valve, an electromagnetic force applied to the movable plate from each of the electromagnets becomes smaller when a distance between the movable plate and the electromagnets sucking the movable plate is increased, and it becomes gradually larger in accordance that the movable plate moves close to the electromagnet. Accordingly, since a displacement speed of the movable plate is increased in accordance that the movable plate moves close to the electromagnet, and the valve portion quickly sits on the intake and exhaust port in accordance therewith, there is a disadvantage that an impact sound and a vibration are generated at a time of closing the valve.

Further, the transmission shaft is separated into a first transmission shaft extended from the valve portion for absorbing an elongation due to a thermal expansion or the like and a second transmission shaft supporting the movable plate. At this time, a spring for urging the valve portion in a valve closing direction is provided in the first transmission shaft. Further, when the movable plate is adsorbed to the upper electromagnet, the valve portion is closed due to the urging force of the spring and a gap on the basis of the thermal expansion or the like is formed between both of the transmission shafts. Further, when the movable plate moves apart from the upper electromagnet, the second transmission shaft is brought into contact with the first transmission shaft, and opens the valve portion against the urging force of the spring. Accordingly, when the movable plate moves apart from the upper electromagnet toward the lower electromagnet at a time of a valve opening operation, there is a disadvantage that the second transmission shaft comes into contact with the first transmission shaft, whereby the impact sound and the vibration are also generated from a contact portion between both of the transmission shafts.

SUMMARY OF THE INVENTION

The present invention is made so as to solve the disadvantages mentioned above, and an object of the present invention is to provide an electromagnetic driving valve of an internal combustion engine provided with a significantly compact shock absorbing means which can reduce an impact sound and a vibration in a contact portion between a first transmission shaft and a second transmission shaft and reduce an impact sound and a vibration generated at a time when a valve portion sits on an intake and exhaust port at a time of closing a valve.

In order to achieve the object mentioned above, in accordance with the present invention, there is provided an electromagnetic driving valve of an internal combustion engine comprising:

- a valve portion moving in contact with and apart from an intake and exhaust port of the internal combustion engine so as to open and close an intake and exhaust passage;
- a first transmission shaft extended from the valve portion toward the above;
- a second transmission shaft extended on the same axis of the first transmission shaft so as to move according to a movement of the first transmission shaft;
- a pair of electromagnets to which said second transmission is inserted, and opposing to each other in a vertical direction with keeping a gap in an axial direction of the second transmission shaft;
- a movable plate provided in the second transmission shaft positioned between both of the electromagnets and moving between both of the electromagnets in correspondence to a magnetic suction between both of the electromagnets, thereby opening and closing the valve portion via the second transmission shaft and the first transmission shaft; and
- a pair of spring members provided so as to vertically oppose to each other via both of the electromagnets and urging the first transmission shaft and the second transmission shaft in respectively opposing directions so as to hold the movable plate and the valve body at a predetermined position, wherein a shock absorbing means provided in the electromagnetic driving valve comprises:

- a contact connecting means connected to an upper end of the first transmission shaft and freely extending and compressing while maintaining a contact with a lower end of the second transmission shaft; and
- a fluid receiving portion slidably inserting the contact connecting means thereto and gradually discharging a fluid charged in an inner portion thereof together with an upward movement of the contact connecting means at a time of a valve closing operation of the valve portion, thereby reducing a valve closing speed of the valve portion via the first transmission shaft.

In accordance with the present invention, since the extensible contact connecting means is provided between the upper end of the first transmission shaft and the lower end of the second transmission shaft, even when an extension due to a thermal expansion is generated in the first transmission shaft or the second transmission shaft, the contact connecting means is compressed so as to absorb the extension of the first transmission shaft and the second transmission shaft, whereby it is possible to maintain the contact connecting state between the first transmission shaft and the second transmission shaft.

In this case, when the movable plate is sucked by the upper electromagnet, the contact connecting means upward moves within the fluid receiving portion due to an urging force of the lower spring member via the first transmission shaft. At this time, since the fluid charged in an inner portion of the fluid receiving portion is gradually discharged, it is possible to prevent the first transmission shaft from suddenly moving via the contact connecting means due to a fluid discharge resistance. Accordingly, a displacement speed of the valve portion at a time of closing the valve can be sufficiently reduced, and it is possible to reduce a sound and a vibration generated at a time when the valve portion sits on the intake and exhaust port.

Further, when the first transmission shaft and the second transmission shaft move, the contact state between both of the shafts can be maintained via the contact connecting means, so that the collision between the upper end of the first transmission shaft and the lower end of the second transmission shaft can be reduced, and it is possible to reduce the sound and the vibration generated between both of the shafts.

Further, in the shock absorbing means, since the structure is made such that the contact connecting means is inward inserted within the fluid receiving portion, it is possible to form the shock absorbing means which can achieve both of an extension absorption and shock absorption of the first transmission shaft and the second transmission shaft, and a shock absorption at a time of closing the valve portion, in a compact manner.

In accordance with one aspect of the present invention, the contact connecting means comprises:

- a cylindrical overcoat member having an upper portion closed by a contact wall brought into contact with a lower end surface of the second transmission shaft;
- an inward insertion member inward inserted to the overcoat member slidably and connected to an upper end portion of the first transmission shaft;
- a fluid receiving chamber formed between the contact wall within the overcoat member and the inward insertion member;
- a fluid introduction passage introducing a fluid to the fluid receiving chamber from an outer portion so as to charge; and
- a fluid discharge passage discharging the fluid charged in the fluid receiving chamber in correspondence to a compression of the fluid receiving chamber caused by an expansion of the first transmission shaft or the second transmission shaft.

The fluid is charged into the fluid receiving chamber via the fluid introduction passage, and a state in which the contact wall of the overcoat member is brought into contact with the lower end surface of the second transmission shaft is maintained. In this case, when the extension due to the thermal expansion is generated in the first transmission shaft or the second transmission shaft, the fluid receiving chamber is compressed. Since the fluid is discharged from the fluid discharge passage in accordance therewith, it is possible to smoothly absorb the extension of the first transmission shaft and the second transmission shaft.

At this time, the fluid discharge passage of the contact connecting means is formed between an inner peripheral wall of the overcoat member and an outer peripheral wall of the inward insertion member. Accordingly, when the extension due to the thermal expansion is generated in the first transmission shaft or the second transmission shaft and the fluid receiving chamber is compressed, it is possible to discharge the fluid from a portion between the inner peripheral wall of the overcoat member and the outer peripheral wall of the inward insertion member, so that it is possible to make the structure simple.

Further, it is preferable that a check valve opening in a direction in which the fluid is introduced from the fluid introduction passage and restricting an outflow of the fluid from the fluid introduction passage so as to maintain the fluid in the fluid receiving chamber at a fixed pressure is provided in the fluid receiving chamber of the contact connecting means. Due to the check valve, it is possible to maintain the fluid charged in the fluid receiving chamber at a fixed pressure, and it is possible to securely maintain a state in which the contact wall of the overcoat member is brought into contact with the lower end surface of the second transmission shaft.

As a particular aspect of the check valve, there can be listed up a structure constituted by a check ball provided in the fluid receiving chamber so as to freely open and close the fluid introduction passage, and a spring urging the check ball in a closing direction.

Further, in the aspect, the structure may be made such that the fluid receiving portion is provided with a fluid supplying passage opening at a position above the overcoat member so as to supply the fluid to an inner portion of the fluid receiving portion when the overcoat member of the contact connecting means moves downward within the fluid receiving portion in accordance with the opening operation of the valve portion, and a fluid discharging passage discharging the fluid in the inner portion of the fluid receiving portion to an outer portion from the fluid receiving portion in accordance with an upward movement of the overcoat member at a time of closing operation of the valve portion.

The fluid is charged to the fluid receiving portion via the fluid supplying passage. Accordingly, since a resistance of the charged fluid is generated in the overcoat member moving upward within the fluid receiving portion, it is possible to reduce a speed of the valve portion via the first transmission shaft on the basis of a significantly simple structure.

At this time, it is preferable that the fluid discharging passage of the fluid receiving portion is formed between an inner peripheral wall of the fluid receiving portion and an outer peripheral wall of the overcoat member in the contact connecting means, the fluid receiving portion is provided with a first small diameter portion having an inner diameter smaller than the other portions in an upper end portion thereof, and the overcoat member is provided with a second small diameter portion having an outer diameter smaller than the other portion in correspondence to the first small diameter portion and reducing a discharging amount of the fluid from the fluid discharging passage of the fluid receiving portion in accordance with an upward movement of the overcoat member.

Accordingly, since a diameter of the fluid discharging passage formed between the inner peripheral wall of the fluid receiving portion and the outer peripheral wall of the overcoat member in the contact connecting means is made small when the second small diameter portion moves forward to the first small diameter portion in accordance with the upward movement of the overcoat member within the fluid receiving portion, it is possible to reduce the discharging amount of the fluid immediately before the valve portion is brought into contact with the intake and exhaust port. Accordingly, it is possible to make the structure significantly simple and it is possible to smoothly execute a sudden speed reduction of the valve portion immediately before closing the valve.

DESCRIPTION OF PREFERRED EMBODIMENT

Figure 1:
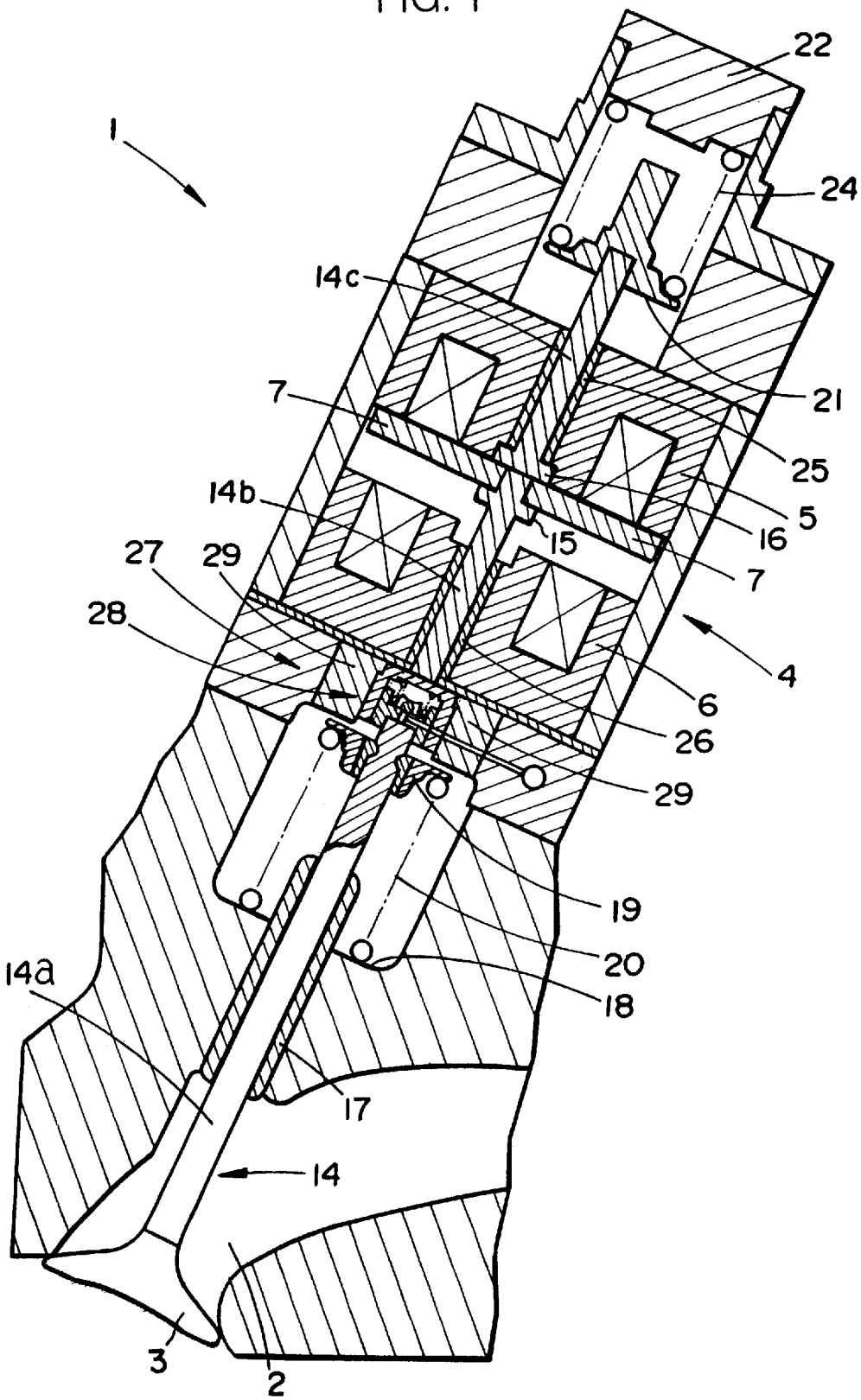
FIG. 1 is a schematic vertical cross sectional view showing an electromagnetic driving valve in accordance with an embodiment of the present invention.
Figure 2A:
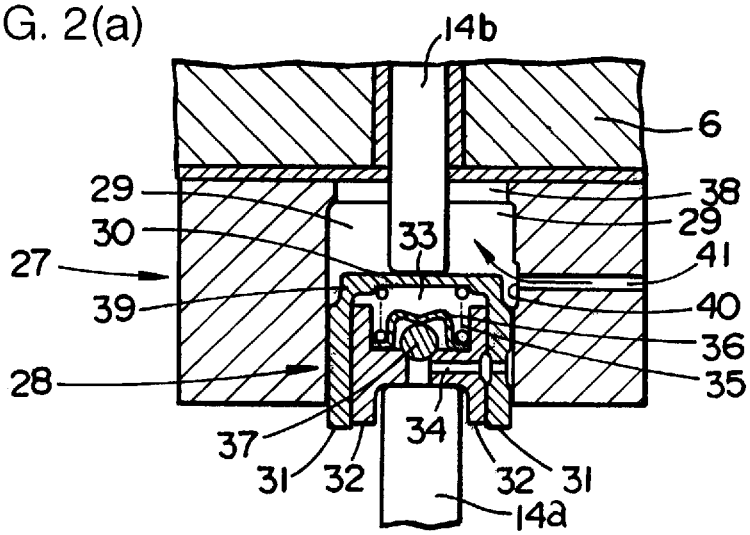
FIG. 2A is a schematic view showing an operation of a shock absorbing means at a time of opening a valve.
Figure 2B:
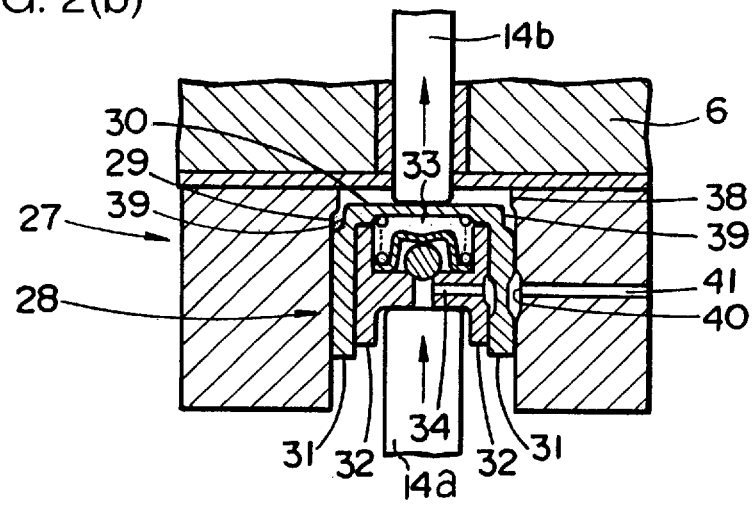
FIG. 2B is a schematic view showing an operation of the shock absorbing means at a time of moving upward.
Figure 2C:
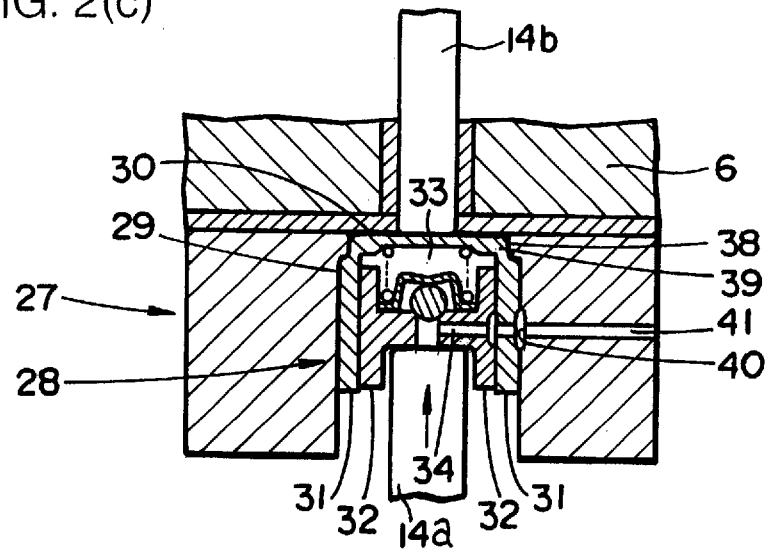
FIG. 2C is a schematic view showing an operation of the shock absorbing means at a time of closing the valve.

A description will be given of an embodiment in accordance with the present invention with reference to the accompanying drawings. FIG. 1 is a schematic vertical cross sectional view showing an electromagnetic driving valve in accordance with the present embodiment, and FIGS. 2A, 2B and 2C are schematic views showing an operation of a shock absorbing means.

An electromagnetic driving valve 1 in accordance with the present embodiment is provided, as shown in FIG. 1, in an intake (or exhaust) passage 2 of an internal combustion engine, and is constituted by a valve portion 3 opening and closing the intake passage 2, and a driving portion 4 driving the valve portion 3 in an opening and closing direction. The driving portion 4 is constituted by a first electromagnet 5 provided at an upper position in FIG. 1, a second electromagnet 6 provided at a position below the first electromagnet 5 in an opposing manner, and a movable plate 7 positioned between both of the electromagnets 5 and 6. The movable plate 7 is formed by a disc-like magnetic metal, and is structured such as to vertically move due to a magnetic suction force of both of the electromagnets 5 and 6.

A transmission shaft 14 is provided in the valve portion 3 in an extending manner. The transmission shaft 14 is separated into a plurality of sections. That is, the transmission shaft 14 is constituted by a first transmission shaft 14*a* having a lower end to which the valve portion 3 is integrally connected, a second transmission shaft 14*b* brought into contact with an upper end of the first transmission shaft 14*a* so as to extend upward and having an expanded portion 15 formed in an upper end thereof via which the movable plate 7 is connected, and a third transmission shaft 14*c* extended upward on the same axis of the second transmission shaft 14*b* and having an expanded portion 16 formed in a lower end thereof via which the movable plate 7 is connected.

The first transmission shaft 14*a* is slidably supported to a supporting member 17 provided in an upper wall portion of the intake passage 2, and supports the valve portion 3 at a position opening and closing the intake passage 2. The first transmission shaft 14*a* is urged upward by a first spring member 20 provided between a seat portion 18 in an upper surface side of the upper wall portion in the intake passage 2 and an upper spring seat 19 fixed to the first transmission shaft 14*a*. Accordingly, an urging force generated by the first spring member 20 is always applied upward to the first transmission shaft 14*a*.

Further, the third transmission shaft 14*c* is urged downward by a second spring member 24 provided between a lower spring seat 21 fixed to an upper end thereof and a fixing member 22 disposed thereabove. Accordingly, an urging force generated by the second spring member 24 is always applied downward to the third transmission shaft 14*c*.

The third transmission shaft 14*c* extends through an inner portion of the first electromagnet 5 and is slidably inserted and supported to the first electromagnet 5 via a guiding tube 25. In the same manner, the second transmission shaft 14*b* extends through an inner portion of the second electromagnet 6 and is inserted and supported to the second electromagnet 6 via a guiding tube 26.

Further, a shock absorbing means 27 is provided between the second electromagnet 6 and the first spring member 20. The shock absorbing means 27 is provided with a contact connecting means 28 connected to the upper end of the first transmission shaft 14*a* and brought into contact with the lower end of the second transmission shaft 14*b*, and an oil receiving portion 29 corresponding to a fluid receiving portion movably receiving the contact connecting means 28 and within which an oil is charged, as shown in FIGS. 1 and 2A.

The contact connecting means 28 is provided with a cylindrical overcoat member 31 having an upper portion closed by a flat contact wall 30, and an inward insertion member 32 inward inserted to the overcoat member 31 slidably, as shown in FIG. 2A. An oil receiving chamber 33 in which an oil (a lubricating oil of the internal combustion engine) is charged is formed in an inner portion of the overcoat member 31. An oil introduction passage 34 introducing the oil to the oil receiving chamber 33 from an outer portion is formed in the overcoat member 31 and the inward insertion member 32. Further, in the oil receiving chamber 33, a so-called check valve is constructed by a cap member 36 urged in a closing direction by a spring 35 and a check ball 37, whereby it is possible to maintain the oil introduced from the oil introduction passage 34 at a fixed pressure in the oil receiving chamber 33. Further, when the oil receiving chamber 33 in which the oil is charged becomes over a predetermined internal pressure, the oil in the oil receiving chamber 33 flows out through a discharge passage formed between the inward insertion member 32 and the overcoat member 31 and is diffused as a lubricating oil.

The oil receiving portion 29 is provided with an oil supply port 40 for supplying the oil in an inner portion thereof, and the oil supply port 40 is connected to an oil flow passage 41 connected to an oil pump (not shown) or the like. The oil charged in the inner portion of the oil receiving portion 29 flows out through a discharge passage formed between an inner wall of the oil receiving portion 29 and an outer wall of the overcoat member 31, and is diffused as a lubricating oil.

Further, a first small diameter portion 38 having an inner diameter smaller than the other portions is formed in an upper end portion of the oil receiving portion 29. Further, a second small diameter portion 39 having an outer diameter smaller than the other portions is formed in an upper end of the overcoat member so as to correspond to the first small diameter portion 38. Accordingly, when the second small diameter portion 39 moves forward to the first small diameter portion 38, a diameter of the discharge passage formed between the inner wall of the oil receiving portion 29 and the outer wall of the overcoat member 31 is reduced, whereby an interval in an upper end portion between the inner wall of the oil receiving portion 29 and the outer wall of the overcoat member 31 is throttled, so that a flow amount of the discharged oil is reduced.

Next, a description will be given of an operation of the electromagnetic driving valve 1 in accordance with the present embodiment structured in the manner mentioned above. In FIG. 1, there is shown a state in which the movable plate 7 is adsorbed to the first electromagnet 5 and the valve portion 3 closes the intake passage 2. In this case, when a feed to the first electromagnet 5 is stopped and a feed to the second electromagnet 6 is simultaneously executed, the movable plate 7 moves downward due to a magnetic suction of the second electromagnet 6. In accordance therewith, the valve portion 3 moves in a direction of opening the intake passage 2 (toward a lower portion in the drawing).

In this case, when the movable plate 7 is adsorbed to the electromagnet 6 and the valve portion 3 opens the intake passage 2, the second transmission shaft 14*b* becomes in a state of pressing down the first transmission shaft 14*a* via the contact connecting means as shown in FIG. 2A, and the oil is charged in the oil receiving portion 29 in the shock absorbing means 27 via the oil supply port 40. At this time, when an extension is generated in the first transmission shaft 14*a* or the second transmission shaft 14*b* due to a thermal expansion, the oil within the oil receiving chamber 33 of the overcoat member 31 flows out and the inward insertion member 32 moves upward so as to absorb the extension.

Next, with reference to FIG. 1, the feed to the first electromagnet 5 is executed at the same time when the feed to the second electromagnet 6 is stopped, and the movable plate 7 is moved toward the first electromagnet 5. In accordance therewith, the first transmission shaft 14*a* is pushed up due to an urging operation of the second spring member 24, and the contact connecting means 28 moves upward within the oil receiving portion 29, as shown in FIG. 2B. Accordingly, a discharge resistance of the oil within the oil receiving portion 29 is increased, and a moving speed of the valve portion 3 (shown in FIG. 1) is reduced. Further, immediately before the valve portion 3 sits on (closes) the intake passage 2, the second small diameter portion 39 of the overcoat member 31 moves forward to the first small diameter portion 38 of the oil receiving portion 29, whereby the discharge resistance of the oil within the oil receiving a portion 29 is suddenly increased, so that an impact at a time when the valve portion 3 sits on the intake passage 2 is reduced. On the contrary, at this time, the oil introduction passage 34 of the overcoat member 31 and the inward insertion member 32 is connected to the oil supply port 40 of the oil receiving portion 29. Accordingly, in the case that the inward insertion member 32 exists at the position above the overcoat member 31, the oil is introduced within the oil receiving chamber 33 of the overcoat member 31, whereby the overcoat member 31 moves upward with respect to the inward insertion member 32. Therefore, the contact connecting means 28 follows to the upward movement of the second transmission shaft 14*b*, whereby the contact state with the second transmission shaft 14*b* is maintained. Further, as shown in FIG. 1, when the movable plate 7 is adsorbed to the electromagnet 5 and the valve portion 3 is in the closed state, the connecting state between the first transmission shaft 14*a* and the second transmission shaft 14*b* via the contact connecting means 28 is maintained as shown in FIG. 2C.

Thereafter, even when the movable plate 7 moves downward due to the magnetic suction operation of the second electromagnet 6, the contact connecting means 28 always maintains the contact state with the second transmission shaft 14*b*, so that it is possible to prevent an impact sound and a vibration from being generated.

As shown in the present embodiment mentioned above, in accordance with the present invention, it is not only possible to reduce the impact sound and the vibration generated at a time when the valve portion 3 sits on the intake passage 2 at a time of closing the valve due to the provision of the shock absorbing means 27, it is but also possible to reduce the impact sound and the vibration generated in the contact portion between the first transmission shaft 14*a* and the second transmission shaft 14*b*. Further, since the contact connecting means 31 is provided in the shock absorbing means 27, it is possible to form in a compact manner and it is possible to make the electromagnetic driving valve compact.

What is claimed is:

1. An electromagnetic driving valve of an internal combustion engine comprising:

a valve portion moving in contact with and apart from an intake and exhaust port of the internal combustion engine so as to open and close an intake and exhaust passage;

a first transmission shaft extended from said valve portion toward the above;

a second transmission shaft extended on the same axis of said first transmission shaft so as to move according to a movement of said first transmission shaft;

a pair of electromagnets to which said second transmission is inserted, and opposing to each other in a vertical direction with keeping a gap in an axial direction of said second transmission shaft;

a movable plate provided in said second transmission shaft positioned between both of the electromagnets and moving between both of the electromagnets in correspondence to a magnetic suction between both of the electromagnets, thereby opening and closing said valve portion via said second transmission shaft and said first transmission shaft; and a pair of spring members provided so as to vertically oppose to each other via both of the electromagnets and urging the first transmission shaft and the second transmission shaft in respectively opposing directions so as to hold said movable plate and said valve body at a predetermined position, wherein shock absorbing means provided in the electromagnetic driving valve comprises:

contact connecting means connected to an upper end of said first transmission shaft and freely extending and compressing while maintaining a contact with a lower end of said second transmission shaft; and a fluid receiving portion slidably inserting said contact connecting means thereto and gradually discharging a fluid charged in an inner portion thereof together with an upward movement of said contact connecting means at a time of a valve closing operation of said valve portion, thereby reducing a valve closing speed of the valve portion via said first transmission shaft.

2. An electromagnetic driving valve of an internal combustion engine according to claim 1, wherein said contact connecting means comprises:

a cylindrical overcoat member having an upper portion closed by a contact wall brought into contact with a lower end surface of said second transmission shaft;

an inward insertion member inward inserted to said overcoat member slidably and connected to an upper end portion of said first transmission shaft;

a fluid receiving chamber formed between said contact wall within said overcoat member and the inward insertion member;

a fluid introduction passage introducing a fluid to said fluid receiving chamber from an outer portion so as to charge; and a fluid discharge passage discharging the fluid charged in said fluid receiving chamber in correspondence to a compression of said fluid receiving chamber caused by an expansion of said first transmission shaft or said second transmission shaft.

3. An electromagnetic driving valve of an internal combustion engine according to claim 2, wherein the fluid discharge passage of said contact connecting means is formed between an inner peripheral wall of said overcoat member and an outer peripheral wall of said inward insertion member.

4. An electromagnetic driving valve of an internal combustion engine according to claim 2, wherein a check valve opening in a direction in which the fluid is introduced from the fluid introduction passage and restricting an outflow of the fluid from the fluid introduction passage so as to maintain the fluid in said fluid receiving chamber at a fixed pressure is provided in the fluid receiving chamber of said contact connecting means.

5. An electromagnetic driving valve of an internal combustion engine according to claim 4, wherein said check valve is constituted by a check ball provided in said fluid receiving chamber so as to freely open and close said fluid introduction passage, and a spring urging said check ball in a closing direction.

6. An electromagnetic driving valve of an internal combustion engine according to claim 2, wherein said fluid receiving portion is provided with a fluid supplying passage opening at a position above said overcoat member so as to supply the fluid to an inner portion of said fluid receiving portion when the overcoat member of said contact connecting means moves downward within said fluid receiving portion in accordance with the opening operation of the valve portion, and a fluid discharging passage discharging the fluid charged in the inner portion of said fluid receiving portion to an outer portion from said fluid receiving portion in accordance with an upward movement of said overcoat member at a time of closing operation of said valve portion.

7. An electromagnetic driving valve of an internal combustion engine according to claim 6, wherein the fluid discharging passage of said fluid receiving portion is formed between an inner peripheral wall of said fluid receiving portion and an outer peripheral wall of the overcoat member in said contact connecting means, said fluid receiving portion is provided with a first small diameter portion having an inner diameter smaller than the other portions in an upper end portion thereof, and said overcoat member is provided with a second small diameter portion having an outer diameter smaller than the other portion in correspondence to said first small diameter portion and reducing a discharging amount of the fluid from the fluid discharging passage of said fluid receiving portion in accordance with an upward movement of said overcoat member.

* * * * *